US008444119B2

(12) United States Patent
Naegele et al.

(10) Patent No.: US 8,444,119 B2
(45) Date of Patent: May 21, 2013

(54) CARBURETOR

(75) Inventors: Claus Naegele, Stuttgart (DE); Werner Geyer, Berglen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 364 days.

(21) Appl. No.: 12/882,226

(22) Filed: Sep. 15, 2010

(65) Prior Publication Data

US 2011/0068487 A1 Mar. 24, 2011

(30) Foreign Application Priority Data

Sep. 22, 2009 (DE) ..... 10 2009 042 551

(51) Int. Cl.
*F02M 7/133* (2006.01)

(52) U.S. Cl.
USPC ..... 261/35; 261/69.1; 261/DIG. 68; 261/DIG. 74

(58) Field of Classification Search
USPC ..... 261/34.2, 35, 69.1, DIG. 68, DIG. 74
See application file for complete search history.

(56) References Cited

U.S. PATENT DOCUMENTS

| | | | | |
|---|---|---|---|---|
| 3,198,187 | A * | 8/1965 | Bartholomew | 123/579 |
| 3,281,128 | A * | 10/1966 | Phillips | 261/34.2 |
| 3,371,658 | A * | 3/1968 | Turner | 123/179.11 |
| 3,738,622 | A * | 6/1973 | Tuckey | 261/35 |
| 4,018,856 | A * | 4/1977 | Hamakawa et al. | 261/23.2 |
| 4,268,462 | A * | 5/1981 | Ota et al. | 261/40 |
| 4,307,692 | A * | 12/1981 | Fiala | 123/445 |
| 6,394,424 | B2 * | 5/2002 | Pattullo et al. | 261/35 |
| 6,932,058 | B2 | 8/2005 | Nickel et al. | |
| 2002/0163087 | A1 * | 11/2002 | Gerhardy | 261/34.2 |

FOREIGN PATENT DOCUMENTS

| | | | | |
|---|---|---|---|---|
| JP | 5-164001 | A * | 6/1993 | 261/34.2 |

* cited by examiner

*Primary Examiner* — Richard L Chiesa
(74) *Attorney, Agent, or Firm* — Gundrun E. Huckett

(57) ABSTRACT

A carburetor has a housing and an intake passage section disposed in the housing. A throttle element is arranged in the intake passage section and a choke element is arranged in the intake passage section upstream of the throttle element. At least one fuel opening opens downstream of the choke element into the intake passage section. A fuel valve controls a fuel quantity supplied to the at least one fuel opening. At least one auxiliary fuel port opens upstream of the choke element into the intake passage section.

13 Claims, 1 Drawing Sheet

CARBURETOR

BACKGROUND OF THE INVENTION

The invention relates to a carburetor comprising a housing in which an intake passage section is formed, wherein in the intake passage section a throttle element and upstream of the throttle element a choke element are arranged. The carburetor further comprises at least one fuel opening that opens downstream of the choke element into the intake passage section and also comprises a fuel valve that controls the fuel quantity supplied to the fuel opening.

U.S. Pat. No. 6,932,058 discloses a carburetor in which the fuel quantity supplied to the intake passage is controlled by a switch valve as a function of the engine speed of the internal combustion engine. In this way, the internal combustion engine can be kept ready to run even with the starter device being engaged.

During start-up while the starting device is engaged, the internal combustion engine is supplied with only a minimal amount of combustion air. In accordance with this, the fuel quantity that is supplied to the intake passage section must also be minimal. At full load of the internal combustion engine it must be ensured that the intake passage section can be supplied with the entire required fuel quantity and, for this purpose, the fuel valve must have a sufficiently large maximum throughput. It has been found that designing the fuel valve, in particular in carburetors of internal combustion engines with comparatively large engine displacement, can be a difficult task because fuel valves that provide for a sufficiently large throughput cannot meter minimal fuel quantities in a sufficiently precise way.

It is therefore an object of the present invention to provide a carburetor of the aforementioned kind that enables a precise metering of small fuel quantities and at the same time is capable of supplying a sufficiently large maximum fuel quantity.

SUMMARY OF THE INVENTION

In accordance with the present invention, this is achieved in that at least one auxiliary fuel port is provided that opens upstream of the choke element into the intake passage section.

By means of the auxiliary fuel port, additional fuel can be made available under full load of the internal combustion engine. In this way, a fuel valve with a smaller maximum throughput can be selected that enables during the starting process a precise metering of minimal fuel quantities. In this way, a fuel valve of a comparatively simple design can be employed. Since the auxiliary fuel port opens upstream of the choke element into the intake passage section, there is no underpressure acting on the auxiliary fuel port when the choke element is closed and no fuel is conveyed through the auxiliary fuel port into the intake passage section. Fuel is supplied through the auxiliary fuel port only at the time when the choke element opens. Because of the selected position of the auxiliary fuel port, it is thus ensured in a simple way that upon start-up of the internal combustion engine, when only minimal fuel quantities are to be supplied, no additional fuel will reach the intake passage section through the auxiliary fuel port. By positioning the auxiliary fuel port upstream of the choke element, no additional switch valves or the like are required for control of the auxiliary fuel port. A simple configuration is thus provided.

Advantageously, the auxiliary fuel port is supplied with the required fuel through an auxiliary fuel path independent of the fuel valve, The auxiliary fuel path has advantageously a check valve or non-return valve that opens in flow direction toward the auxiliary fuel port. In this way it is prevented that combustion air can enter the auxiliary fuel path. Expediently, the auxiliary fuel path has a fixed throttle bore. By means of the fixed throttle bore, the maximum fuel quantity that can be supplied through the auxiliary fuel path to the intake passage section can be constructively predetermined. The throttle is expediently designed such that for completely open throttle element and completely open choke element, i.e., for full load of the internal combustion engine, approximately 10% to 40% of the fuel quantity to be supplied through the intake passage section is supplied through the auxiliary fuel port. Since a significant proportion of the fuel quantity to be supplied in total is supplied through the auxiliary fuel port, the fuel valve can be sized smaller accordingly so that minimal fuel quantities can be metered in a precise way. Expediently, the fuel valve is a solenoid valve. Advantageously, the fuel valve is open in the currentless state.

Advantageously, the carburetor is a diaphragm carburetor and has a control chamber that is delimited by a control diaphragm that is loaded by a reference pressure. The fuel supply into the intake passage is realized as a result of the underpressure or vacuum existing in the intake passage section. Injection of fuel into the intake passage section is not provided for. Expediently, all fuel openings that open into the intake passage section are supplied with fuel from the control chamber.

Advantageously, at least one fuel opening is a main fuel opening that in the area of a venturi section opens into the intake passage section. At least one fuel opening is in particular an idle fuel opening that opens in the area of the throttle element into the intake passage section. In particular, several idle fuel openings are provided that are supplied from a common idle fuel chamber with fuel, In this connection, advantageously at least one idle fuel opening opens upstream of the completely closed throttle flap into the intake passage section and one idle fuel opening downstream of the completely closed throttle valve.

In addition, at least one partial load fuel opening can be provided that opens in the area of the throttle element into the intake passage section. The fuel quantity that is supplied through the partial load fuel opening is advantageously also controlled by the fuel valve.

A simple configuration results when the throttle element is a throttle flap and the choke element is a choke flap. In order to ensure in any operating state a minimal fuel quantity supply to the intake passage section, a bypass passage can be provided that circumvents the fuel valve. The bypass passage opens advantageously into a main fuel path that opens through the main fuel opening into the intake passage.

DESCRIPTION OF THE PREFERRED EMBODIMENTS

Figure 1:
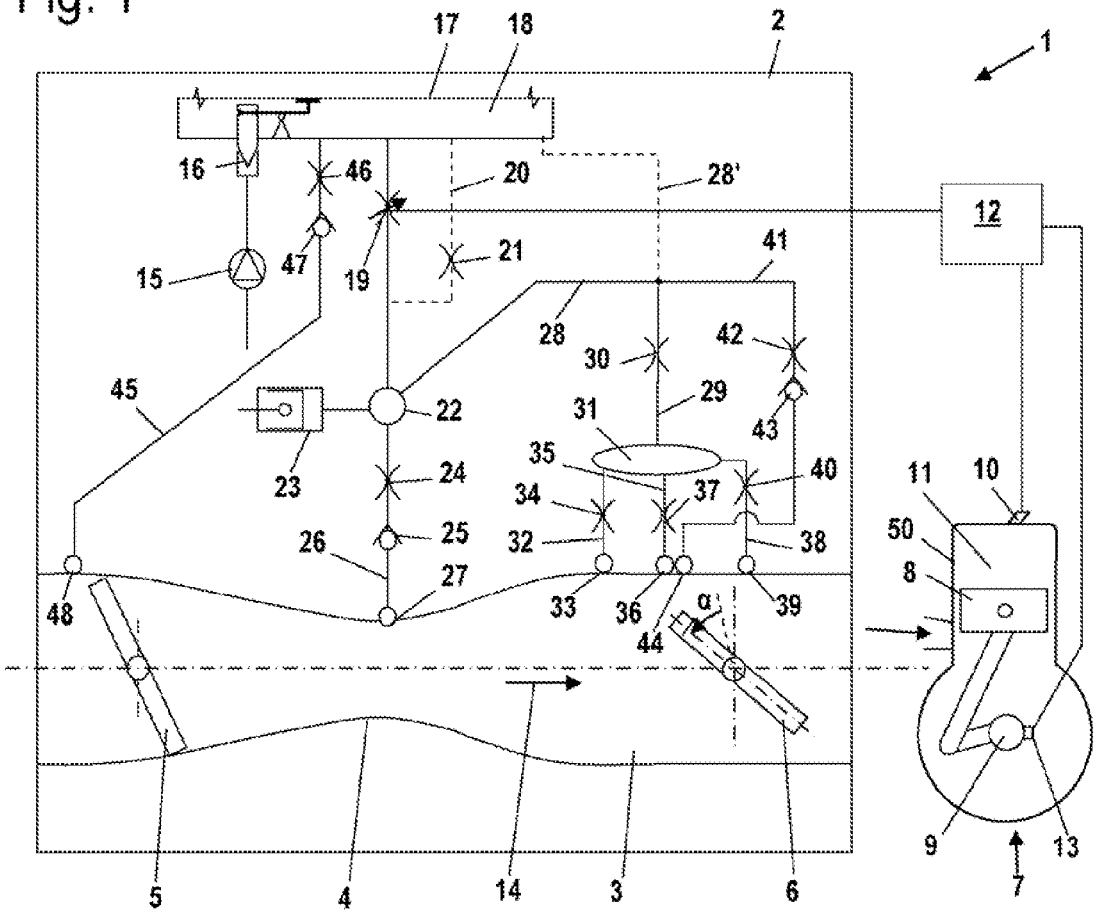
FIG. 1 is a schematic illustration of a carburetor.

Carburetor 1 illustrated in FIG. 1 supplies a fuel/air mixture to an internal combustion engine 7. The internal combustion engine 7 can be, for example, the drive motor in a hand-held power tool such as a motor chainsaw, a cut-off machine, a trimmer or the like. The carburetor 1 has a housing 2 in which an intake passage section 3 is formed, Combustion air flows in the intake passage section 3 and fuel is supplied thereto in the carburetor 1 so that a fuel/air mixture is formed that is supplied in flow direction 14 to the internal combustion engine 7. The internal combustion engine 7 has a combustion chamber 11 that is delimited by piston 8. The piston 8 drives a crankshaft 9 in rotation. A spark plug 10 projects into the combustion chamber 11 and is controlled by electronic control unit 12. An engine speed sensor 13 is arranged on the crankshaft 9 and is formed, for example, by a generator or the ignition device of the internal combustion engine 7. The engine speed sensor 13 is also connected to the electronic control unit 12 The intake passage section 3 opens into the cylinder 50 of the internal combustion engine 7 in an area that is piston-controlled by piston 8.

In the intake passage section 3 a venturi section 4 is formed where the main fuel opening 27 opens into the intake passage section 3. The main fuel opening 27 is supplied with fuel by a main fuel path 26 in which a check valve or non-return valve 25 and a throttle 24 are arranged. The throttle 24 may be adjustable by the operator or can be designed as a fixed throttle bore.

In the flow direction 14 downstream of the venturi section 4, a throttle valve 6 is pivotably supported in the intake passage section 3. In the area of the throttle valve 6 there are three idle fuel openings 33, 36 and 39 that open into the intake passage section 3. When the throttle flap 6 is completely closed, the idle fuel openings 33 and 36 open upstream of the throttle flap 6 into the intake passage section 3 while the idle fuel opening 39 opens downstream of the throttle flap 6 into the intake passage section 3. All idle fuel openings 33, 36 and 39 are connected to an idle fuel chamber 31 by means of a fuel path 32, 35, 38, respectively, in which a throttle 34, 37, 40 is disposed. The idle fuel opening 33 is connected by means of idle fuel path 32 to the idle fuel chamber 31, the idle fuel opening 36 is connected by means of idle fuel path 35 to the idle fuel chamber 31, and the idle fuel opening 39 is connected by means of idle fuel path 38 to the idle fuel chamber 31.

For completely closed throttle flap 6, combustion air can be sucked in via the idle fuel openings 33 and 36 into the idle fuel chamber 31, where it forms an emulsion with the fuel and is then conveyed through the idle fuel opening 39 into the intake passage section 3 downstream of the throttle flap 6.

In the area of the throttle flap 6, a partial load fuel opening 44 opens also into the intake passage section 3. The partial load fuel opening 44 is supplied with fuel by a partial load fuel path 41 in which a throttle 42 and a check valve or non-return valve 43 are arranged. The check valve (non-return valve) 43 opens in flow direction toward the partial load fuel opening 44. The idle fuel chamber 31 is connected by means of idle fuel path 29, in which a throttle 30 is arranged to the auxiliary fuel path 28 and also the partial load fuel path 41 opens into the auxiliary fuel path 28. The auxiliary fuel path 28 is thus divided in the flow direction toward the intake passage section 3 into the idle fuel path 29 and the partial load fuel path 41.

In the illustrated embodiment, the auxiliary flow path 28 branches off an annular gap 22 of the main fuel path 26. An acceleration pump 23 is connected to annular gap 22 and by means of the pump 23, upon acceleration, additional fuel is pumped into the intake passage section 3. The main fuel path 26 is connected by means of fuel valve 19 to the control chamber 18. The control chamber 18 therefore supplies the main fuel opening 27, the partial fuel opening 44, and the idle fuel openings 33, 36, 39 with fuel. By means of the fuel valve 19 the fuel quantity x that is supplied to these fuel openings is controlled. The fuel valve 19 is connected to the electronic control unit 12 that controls the fuel valve 19, for example, as a function of the engine speed of the internal combustion engine 7. The fuel valve 19 is advantageously configured as a solenoid valve that is in particular open when in the currentiess state. In order to be able to supply a minimum quantity of fuel to the intake passage section 3 when the fuel valve 19 is closed, a bypass channel 20 can be provided that bypasses the fuel valve 19 and connects the control chamber 18 with the main fuel path 26 downstream of the fuel valve 19. For adjusting the fuel quantity, in the bypass passage 20 a throttle 21 is arranged that advantageously is a fixed throttle bore.

The control chamber 18 is delimited by a control diaphragm 17 that is loaded by a reference pressure, for example, ambient pressure or by the pressure in the clean chamber of an air filter of the internal combustion engine 7. The deflection of the control diaphragm 17 controls an inlet valve 16 by means of which fuel that is conveyed by a fuel pump 15 reaches the control chamber 18. The fuel pump 15 can be, for example, in the form of a diaphragm pump that is driven by the fluctuating crankcase pressure of the internal combustion engine 7.

Upstream of the venturi section 4 in the intake passage section 3 a choke flap 5 is pivotably supported. Upstream of the choke flap 5 an auxiliary fuel port 48 opens into the intake passage section 3 that is supplied by an auxiliary fuel path 45, The auxiliary fuel path 45 connects the auxiliary fuel port 48 directly with the control chamber 18. The fuel quantity x that is supplied to the auxiliary fuel port 48 is thus not controlled by the fuel valve 19. In the auxiliary fuel path 45 a fixed throttle bore 46 and a check valve (non-return valve) 47 are arranged. The check valve (non-return valve) 47 opens in flow direction toward the auxiliary fuel port 48.

Figure 2:
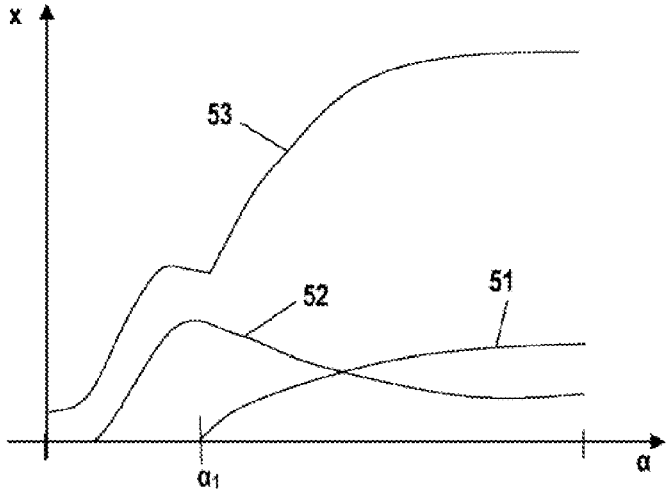
FIG. 2 is a diagram that illustrates the fuel quantities supplied to the intake passage section plotted against the throttle flap angle.

The open position of the throttle flap 6 is indicated by throttle flap angle a that is schematically indicated in FIG. 1, FIG. 2 shows the supplied fuel quantity x schematically as a function of the throttle flap angle a. The curve 51 in this case indicates the fuel quantity x supplied through the auxiliary fuel port 48, the curve 52 indicates the fuel quantity x supplied through the partial load fuel opening 44, and the curve 53 indicates the entire fuel quantity x that is supplied to the intake passage section 3. For completely closed throttle flap 6, a minimal fuel quantity x is supplied through the idle fuel openings 33, 36, and 39. This fuel quantity x is controlled by the fuel valve 19. As soon as the edge of the throttle flap 6 has moved across the area of the partial load fuel opening 44, fuel is supplied also through the partial load fuel opening 44, In this area the curve 52 shows an increase. By means of the auxiliary fuel port 48 no fuel is supplied yet. The choke flap 5 is completely open in this position of the throttle flap 6. At this operating point the flow velocity at the auxiliary fuel port 48 is so minimal that no fuel is sucked in through the auxiliary fuel opening 48 into the intake passage section 3. Only once the flow velocity has increased, as indicated schematically in the example by the throttle flap angle $\alpha_1$, fuel flows also through the auxiliary fuel port 48 into the intake passage section 3. Since the underpressure or vacuum at the partial load fuel opening 44 decreases in this area as a result of further opening of the throttle flap 6 and the thus resulting increased flow cross-section, the quantity of fuel supplied through the partial load fuel opening 44 decreases.

When starting the engine, the choke flap 5 is completely closed and the throttle flap 6 is partially open. This flap position is indicated in FIG. 1. As a result of the choke flap 5 being closed, no vacuum exists at the auxiliary fuel port 48 and no fuel is sucked through the auxiliary fuel port 48 into the intake passage section 3.

As illustrated in FIG. 2, the auxiliary fuel port 48 is without any effect for substantially closed throttle flap 6 as well as closed choke flap 5. Only for a comparatively large fuel quantity x to be supplied in total, through the auxiliary fuel port 48 fuel is also supplied into the intake passage section 3. Through the auxiliary fuel port 48, the supplied fuel quantity x for completely open throttle flap 6 and completely open choke flap 5 can thus be increased without having an effect on the precise control of the fuel quantity for substantially closed throttle flap 6 or substantially closed choke flap 5.

It may be provided that the idle system with the idle fuel openings 33, 36, and 39 and the partial load fuel system with the partial load fuel opening 44 as shown in FIG. 1 are controlled by the fuel valve 19. It may however also be expedient that the fuel quantity supplied through the fuel openings 33, 36, 39 and 44 is independent of the fuel valve 19. For this purpose, the fuel path 29 and 41 can be connected directly with the control chamber 13 by means of the auxiliary fuel path 28' that is indicated in dashed lines in FIG. 1.

Instead of an auxiliary fuel port 48 also several auxiliary fuel ports 48 can be provided that open upstream of the choke element into the intake passage section 3. Instead of the throttle flap 6 and the choke flap 5 also choke elements of a different design can be employed, The specification incorporates by reference the entire disclosure of German priority document 10 2009 042 551.9 having a filing date of Sep. 22, 2009.

While specific embodiments of the invention have been shown and described in detail to illustrate the inventive principles, it will be understood that the invention may be embodied otherwise without departing from such principles.

What is claimed is:

1. A carburetor comprising:

a housing;

an intake passage section disposed in said housing;

a throttle element arranged in said intake passage section;

a choke element arranged in said intake passage section upstream of said throttle element;

at least one fuel opening that opens downstream of said choke element into said intake passage section;

a fuel valve controlling a fuel quantity supplied to said at least one fuel opening;

at least one auxiliary fuel port that opens upstream of said choke element into said intake passage section;

an auxiliary fuel path connected to said at least one auxiliary fuel port, wherein said at least one auxiliary fuel port is supplied with fuel, independent of a fuel supply provided by said fuel valve, through said auxiliary fuel path;

a check valve disposed in said auxiliary fuel path, wherein said check valve opens in a flow direction toward said at least one auxiliary fuel port;

wherein said auxiliary fuel path comprises a fixed throttle bore designed such that, when said throttle element is completely open and said choke element is completely open, approximately 10% to approximately 40% of a fuel quantity supplied in total to said intake passage section is supplied through said at least one auxiliary fuel port.

2. The carburetor according to claim 1, wherein said fuel valve is a solenoid valve.

3. The carburetor according to claim 1, wherein said carburetor is a diaphragm carburetor and comprises a control chamber and a control diaphragm delimiting said control chamber, wherein said control diaphragm is loaded by a reference pressure.

4. The carburetor according to claim 3, wherein all of said at least one fuel opening and said at least one auxiliary fuel port that open into said intake passage section are supplied with fuel from said control chamber.

5. The carburetor according to claim 1, wherein said at least one fuel opening is a main fuel opening that opens within a venturi section of said intake passage section into said intake passage section.

6. The carburetor according to claim 1, wherein said at least one fuel opening is an idle fuel opening that opens into said intake passage section in an area where said throttle element is arranged.

7. The carburetor according to claim 6, comprising an idle fuel chamber wherein several of said idle fuel opening are provided and are supplied with fuel from said idle fuel chamber.

8. The carburetor according to claim 7, wherein a fuel quantity supplied to said several idle fuel openings is controlled by said fuel valve.

9. The carburetor according to claim 1, wherein said at least one fuel opening is a partial load fuel opening that opens into said intake passage section in an area where said throttle element is arranged.

10. The carburetor according to claim 9, wherein a fuel quantity supplied to said partial load fuel opening is controlled by said fuel valve.

11. The carburetor according to claim 1, wherein said throttle element is a throttle flap and wherein said choke element is a choke flap.

12. The carburetor according to claim 1, comprising a bypass passage that bypasses said fuel valve.

13. The carburetor according to claim 12, wherein said at least one fuel opening is a main fuel opening and wherein said bypass passage opens into a main fuel path that opens at said main fuel opening into said intake passage section.

* * * * *